US005713167A

United States Patent [19]

Durham et al.

[11] Patent Number: 5,713,167

[45] Date of Patent: Feb. 3, 1998

[54] GLAZING SYSTEM

[76] Inventors: Robert C. Durham; Ruth Ann Durham, both of 3317 SW. 11th Ave., Ft. Lauderdale, Fla. 33315

[21] Appl. No.: 685,249

[22] Filed: Jul. 23, 1996

[51] Int. Cl.[6] ..... E06B 5/10

[52] U.S. Cl. ..... 52/204.54; 52/204.67; 52/204.7; 52/204.69; 52/204.71; 52/482; 52/773; 52/775

[58] Field of Search ..... 52/204.53, 204.54, 52/204.62, 204.67, 204.68, 204.69, 204.7–204.72, 482, 773, 775, 204.5, 476

[56] References Cited

U.S. PATENT DOCUMENTS

| | | | |
|---|---|---|---|
| 1,000,094 | 8/1911 | Klemm . | |
| 1,114,467 | 10/1914 | Goodland et al. | 52/482 |
| 1,458,397 | 6/1923 | Currier . | |
| 1,863,722 | 6/1932 | Levene | 52/775 |
| 2,121,094 | 6/1938 | Nuding et al. . | |
| 2,209,527 | 7/1940 | Knudsen . | |
| 2,304,423 | 12/1942 | Schiller . | |
| 2,837,784 | 6/1958 | Jannette | 52/204.7 X |
| 3,691,713 | 9/1972 | Dulaney | 52/775 X |
| 3,785,106 | 1/1974 | Fink . | |
| 4,164,108 | 8/1979 | Ortmanns | 52/476 X |
| 4,624,091 | 11/1986 | Biro | 52/204.67 X |
| 4,742,664 | 5/1988 | Johnson . | |
| 4,831,804 | 5/1989 | Sayer . | |

FOREIGN PATENT DOCUMENTS

| | | | |
|---|---|---|---|
| 082169508 | 7/1982 | Netherlands | 52/204.69 |

*Primary Examiner*—Robert Canfield
*Attorney, Agent, or Firm*—Oltman,Flynn & Kubler

[57] ABSTRACT

A glazing system for a sliding glass door includes an existing glass pane and an existing door frame having an existing door frame upper surface and having a glass receiving channel recessed into the existing door frame upper surface, the system including a reinforced glass pane having a pane inner face for orienting toward the interior of a building and a pane outer face for orienting toward the outside of a building and having a transparent, shatter-proof film secured onto the pane inner face with a film securing mechanism, and a mounting structure having a mounting member with a member anchoring portion for securing into the channel with an anchoring portion securing mechanism and a pane mounting flange having a flange inner face for directing toward the interior of a building and a flange outer face for directing toward the outside of a building, the film being secured to the flange outer face with a pane securing structure. The mounting member preferably includes a base plate portion for resting on the existing door frame upper surface, and an anchor lip portion extending downwardly from the abutment plate portion for inserting into the channel. The system is also suited to fitting and retrofitting ventilating windows and fixed glass windows.

11 Claims, 4 Drawing Sheets

10
12
14
16
24
3
3

10
12
14
16
18
18a
20
22
24
30
32
34
36
44
46
48
70
72
74
76
78
82
84
92
94
96

GLAZING SYSTEM

BACKGROUND OF THE INVENTION

1. Field of the Invention

The present invention relates generally to the field of window pane mounting and reinforcing structures. More specifically the present invention relates to a glazing system for refitting conventional sliding glass doors, as well as ventilating windows and fixed glass windows, and alternatively for fitting to already manufactured frame members which have not yet been installed, with impact resistant windows. The system includes a reinforced glass pane and a retrofit frame structure which fits and fastens into pane mounting channels of conventional door frame members. The frame structure is cut to fit along the inner edge of an existing door frame.

2. Description of the Prior Art

There have long been window frame glazing systems for mounting glass panes into window openings. A problem with these prior structures has been that they are not designed and adapted to retrofit existing window frames. A plastic film laminated window pane cannot be properly bonded into an existing door frame channel. A supplemental mounting structure must be provided to present a clean, exposed mounting flange to which the window pane film can be bonded.

Currier, U.S. Pat. No. 1,458,397, issued on Jun. 12, 1923, teaches a plate glass setting for installation into a window port in a building wall. The window port includes a horizontal sill plank and an upright stop plank secured longitudinally near the sill plank outer face. The setting includes a metal rail of contoured cross-section seated longitudinally against the sill plank, having one longitudinal rail edge fitted underneath the sill plank and extending up the sill plank inner face, over the upper surface of the sill plank and the inner face of the stop plank and terminating in a second longitudinal rail edge on the upper surface of the stop plank. An upward abutment jog is provided in the rail segment extending over the sill plank upper surface. A separate molding member is fitted against the abutment segment and extends upward to define an upwardly opening, longitudinal gap between the rail and the molding member. Wood screws secure the rail and molding member to the stop plank. A glass pane fits down into the longitudinal gap and rests on a mounting strip within the gap. An elongate block fits into a longitudinal recess in the rail and protrudes toward the molding member to abut and brace the glass pane. A problem with Currier is that its primary parts must be secured to window sill and stop planks, and it is thus not suited to retrofitting an existing window frame.

Sayer, U.S. Pat. No. 4,831,804, issued on May 23, 1989, reveals a window frame apparatus which includes an extruded plastic sash having a recessed portion adapted to receive a glass window pane, and a hollow portion for accepting a flat metal insert. These flat metal inserts form sash connecting elbows and otherwise extend through the sash structure to reinforce the structure against bending caused by high winds. A problem with Sayer is that the structure is not suited to retrofitting an existing window frame. Another problem is that Sayer is relatively complex, having numerous parts, and thus would be costly to manufacture and labor-intensive to install.

Johnson, U.S. Pat. No. 4,742,664, issued on May 10, 1988, teaches a snap-in glazing bead and bead retainer for securing a glass pane into a window frame. The glazing bead retainer includes at least one generally horizontal retaining flange and means for securing the retainer to the window frame. The glazing bead includes a projection for engaging the retaining flange to hold the bead in position, and a substantially vertical window retaining flange for securing glass into the window frame. A problem with Johnson is that it only fits window frames having a specific cross-sectional size and configuration, and would probably not fit most existing window frames. Another problem is that a glazing bead which snaps out easily for servicing might also snap out easily under storm wind loading, freeing the window pane to become airborne.

Fink, U.S. Pat. No. 3,785,106, issued on Jan. 15, 1974, discloses a glazing flange attachment system for a window or building panel. Fink includes a flange and frame structure made up of a glazing flange, a frame member and a compressible spline. The glazing flange is a flat metal strip which is initially separate from and releasably locks into a longitudinal slot in the frame member. The glazing flange has a barbed locating and locking projection which fits into a transverse notch in a slot wall of the frame member to secure the glazing flange against lateral movement and maintain the flange in a desired overlapping relation on the margin of the window or building panel. The glazing flange is securely held against the frame member slot wall and the projection is secured in the notch with a compressible spline which is pressed between the surface of the glazing flange and a stepped seat in a slot wall. Outward displacement of the glazing flange by pressure on the window or panel is prevented by an inclined camming abutment at the end of the slot which engages and confines an edge of the glazing flange. The camming abutment also cams the projection into the notch as the glazing flange is moved into the slot during assembly. A problem with Fink is that it is not designed and structured to retrofit a typical sliding glass door frame.

Knudsen, U.S. Pat. No. 2,209,527, issued on Jul. 30, 1940, teaches a protective alarm system for connection to tempered glass, which does not mar or obscure the glass and does not draw electrical energy during normal service. Schiller, U.S. Pat. No. 2,304,423, issued on Dec. 8, 1942, reveals a metal window sash into which a pane of glass is inserted and marginally sealed and then mounted in a window opening. Klemm, U.S. Pat. No. 1,000,094, issued on Aug. 8, 1911, discloses a window sash including two longitudinally and transversely disposed portions which extend toward each other at the pane side of the stile and are respectively provided with longitudinal, laterally extending parallel flanges. Nuding, et al., U.S. Pat. No. 2,121,094, issued on Jun. 21, 1938, discloses a back-set metal sash for mounting in a window opening. A problem with these latter devices is that none are suited to aftermarket retrofitting of reinforced glass into existing sliding door frames.

It is thus an object of the present invention to provide a door replacement glazing system which retrofits to an existing sliding glass door frame to mount a reinforced glass pane.

It is another object of the present invention to provide such a system which mounts to a variety of existing door frame configurations.

It is still another object of the present invention to provide such a system for which both the mounting structure and the glass pane are resistant to hurricane force winds and to projectile impact, and which can absorb and dissipate the energy of impact without failure.

It is finally an object of the present invention to provide such a system which is fast and easy to install and is relatively inexpensive to manufacture.

SUMMARY OF THE INVENTION

The present invention accomplishes the above-stated objectives, as well as others, as may be determined by a fair reading and interpretation of the entire specification.

A glazing system is provided for a sliding glass door including an existing glass pane and an existing door frame having an existing door frame upper surface and having a glass receiving channel recessed into the existing door frame upper surface, the system including a reinforced glass pane having a pane inner face for orienting toward the interior of a building and a pane outer face for orienting toward the outside of a building and having a transparent, shatter-proof film secured onto the pane inner face with a film securing mechanism, and a mounting structure having a mounting member with a member anchoring portion for securing into the channel with an anchoring portion securing mechanism and a pane mounting flange having a flange inner face for directing toward the interior of a building and a flange outer face for directing toward the outside of a building, the film being secured to the flange outer face with a pane securing structure. The mounting member preferably includes a base plate portion for resting on the existing door frame upper surface, and an anchor lip portion extending downwardly from the abutment plate portion for inserting into the channel. The anchor lip portion preferably includes an L-shape extension having a width substantially equivalent to the width of the channel, and a downwardly projecting bead spaced apart from the upper part of the anchor lip portion L-shape a distance substantially equivalent to the width of the channel for stabilizing the mounting member. The mounting member securing mechanism preferably includes a longitudinal series of fastener head passing holes in the abutment plate of sufficient width to pass the head of a certain threaded fastener and a longitudinal series of fastener shank passing holes in the anchor lip portion of sufficient width to pass the shank of one threaded fastener and each registering with one of the fastener head passing holes, and several threaded fasteners for passing through the fastener head and fastener shank holes and passing into the bottom surface of channel. The film preferably includes a layer of polyester laminated onto the inner pane face and a layer of polyvinyl butyral laminated onto the layer of polyester. The film securing mechanism preferably includes an adhesive. The glazing system preferably additionally includes a tubular shock-absorber encircling the shanks of the threaded fasteners to absorb some of the impact of flying debris. The system preferably further includes a glass pane abutment member having an elongate pane bumper member and a bumper extending and mounting structure for securing the bumper member in a position along the pane outer face for added system strength and enhanced aesthetic quality. The bumper extending and mounting structure preferably includes a bumper member receiving channel for receiving the bumper member, and the abutment member preferably slides longitudinally into a track recessed into the base plate portion.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figures 1, 2:
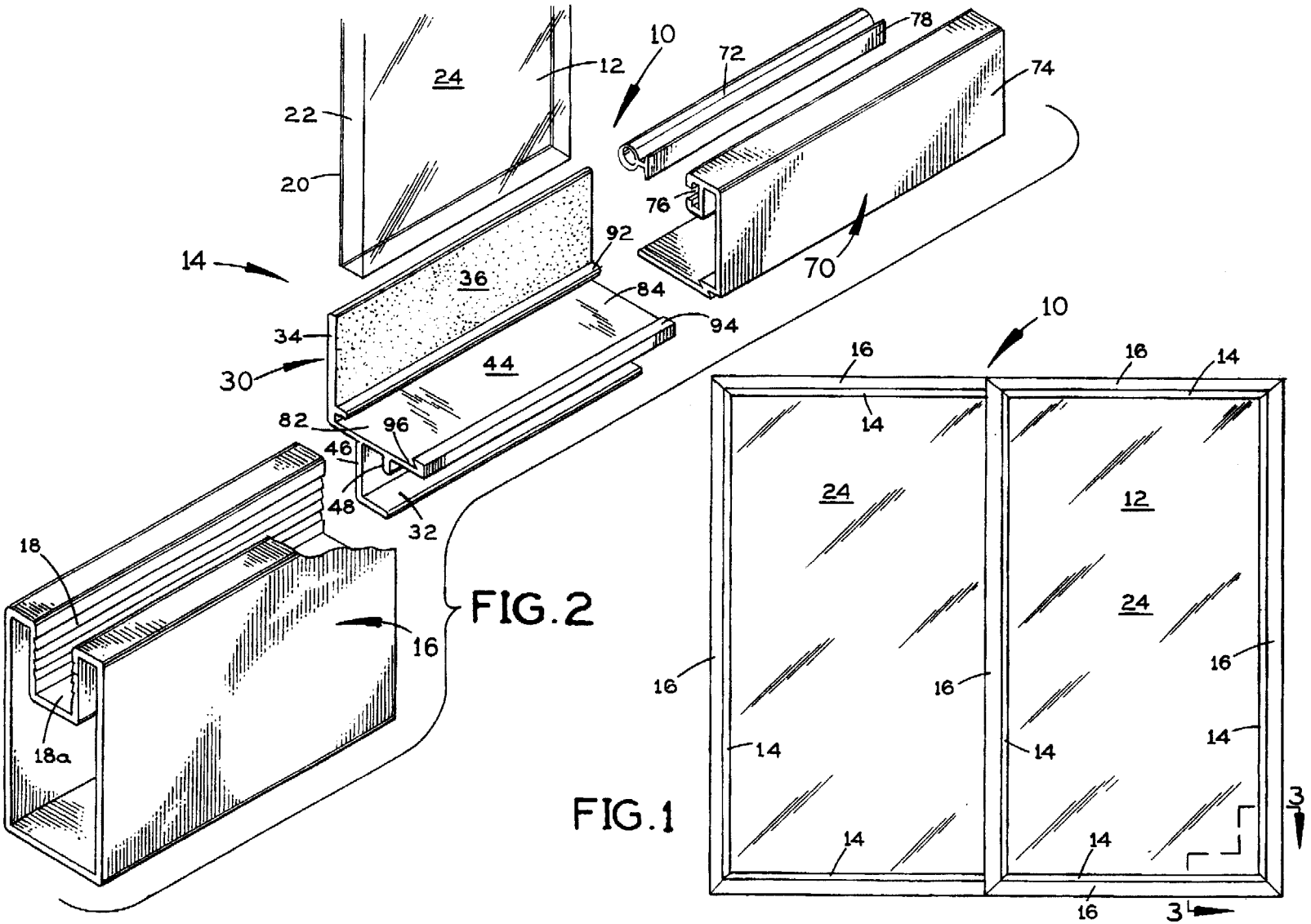
FIG. 1 is a front view of two sliding glass doors into which the preferred embodiment of the present invention may be fitted.
FIG. 2 is a perspective, exploded view of a segment of an existing door frame member aligned to receive in its pane mounting channel the anchor portion of a mounting member, and of a film reinforced glass pane above the mounting flange of the mounting member ready for bonding into place with an adhesive, and of an abutment member aligned to slide into the track in the mounting member base plate.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–9, a glazing system 10 for replacing conventional glass in sliding doors with storm resistant glass panes 12, and alternatively for fitting storm resistant glass into already manufactured door frame members which have not yet been installed, is disclosed. System 10 includes a reinforced glass pane 12 and a system mounting structure 14 which fastens into a pane receiving channel 18 in existing door frame members 16. Mounting structure 14 is cut to fit along the inner edge of frame members 16.

Glass pane 12 has a pane inner face 22 for directing toward the interior of a building and a pane outer face 24 for directing toward the outside surroundings of a building, and is reinforced with a shatter-resistant transparent film 20 secured to inner face 22. Film 20 is preferably a layer of polyester laminated onto pane inner face 22 and a layer of polyvinyl butyral laminated onto the polyester layer. The essential elements of mounting structure 14 are a mounting member 30 having an anchoring portion 32 and a glass pane mounting flange 34. The film 20 of glass pane 12 is bonded to an outwardly directed face 36 of mounting flange 34 with a suitable adhesive.

Figures 3, 4:
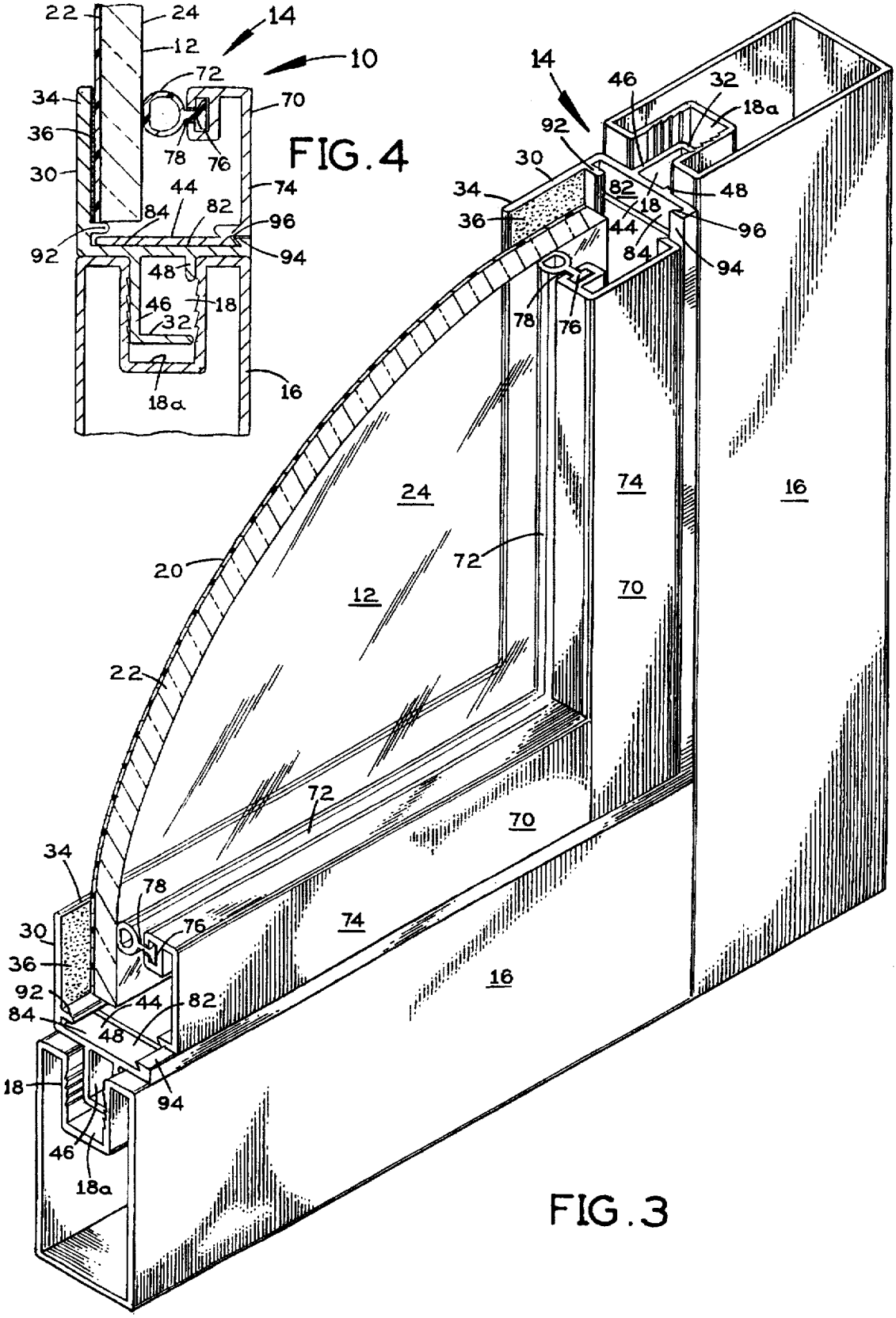
FIG. 3 is a cut-away, perspective view of intersecting door frame members fitted with intersecting segments of the inventive system mounting structure.
FIG. 4 is a cross-sectional view of the upper part of an existing door frame member and the installed preferred embodiment of the inventive system mounting structure.
Figures 5, 6, 7:
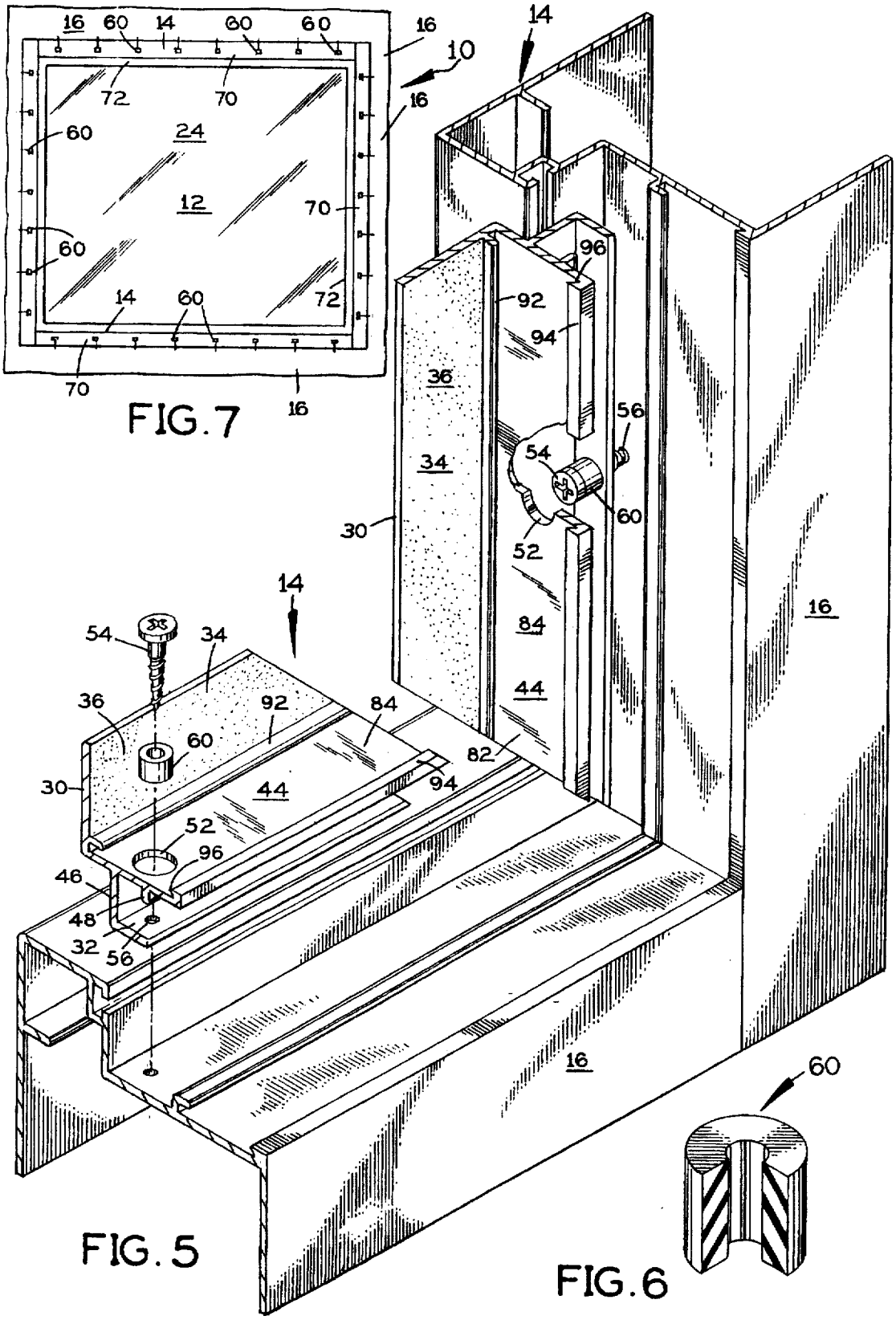
FIG. 5 is a view as in FIG. 3, but with the glass pane removed and a mounting member positioned above and ready to install into an existing frame structure having a exposed wall molding part instead of a channel.
FIG. 6 is a perspective, cut-away view of a shock-absorber and spacer element for dissipating some of the impact energy of a storm wind propelled projectile against the reinforced glass pane.
FIG. 7 is a front view of the mounting structure installed in a door frame, showing the series of shock-absorber and spacer elements around the mounting member perimeter.
Figure 8:
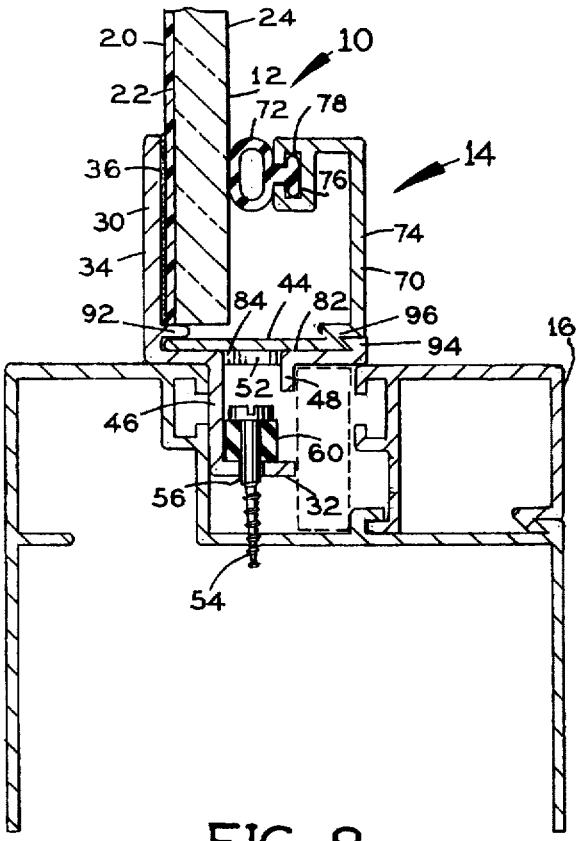
FIG. 8 is a cross-sectional view as in FIG. 4, showing the mounting structure equipped with the shock-absorber and spacer feature, with the spacer elements in their expanded, rest position.
Figure 9:
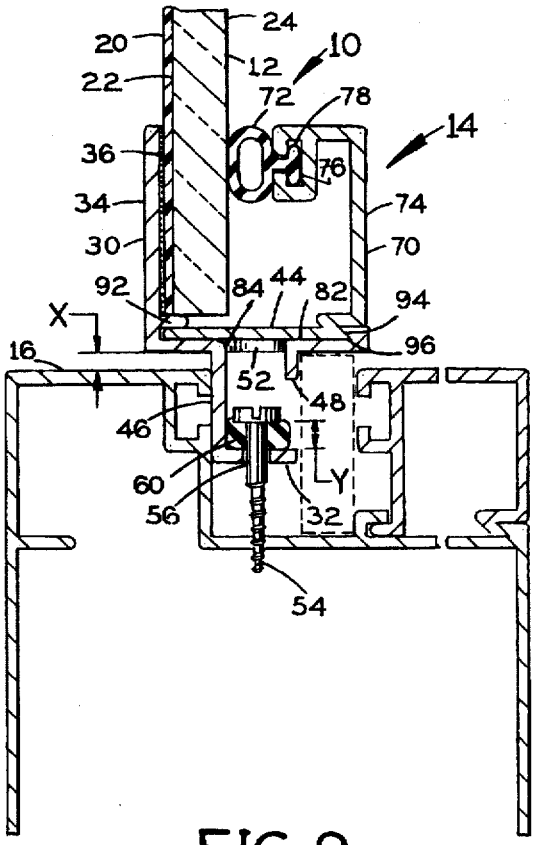
FIG. 9 is a view as in FIG. 8, except that the spacer elements are shown compressed as they would be when absorbing loading from projectile impact against the pane.

Mounting member 30 preferably includes a base plate portion 44 for resting on existing frame 16. Anchoring portion 32 preferably takes the form of an anchor lip structure 46 extending downwardly from base plate portion 44 for fastening into a pane receiving channel 18 in an existing door frame member 16. Anchor lip structure 46 has a cross-sectional L-shape as shown in FIG. 4, and has a width substantially matching the width of pane receiving channel 18 for making a snug fit. A downwardly projecting bead 48, spaced apart from the upper leg of the anchor lip structure 46 L-shape a distance substantially matching the width of the channel 18, is provided to further stabilize each mounting member 30. See FIG. 4.

To fasten mounting member 30 to an existing frame member 16, a series of fastener head holes 52 are drilled through base plate portion 44 which are of sufficient width to pass the head of a suitable sheet metal screw 54, and a series of registering fastener shank holes 56 are drilled below each fastener head hole 52 through the lower leg of anchor lip structure 46 which are of sufficient width to pass the shank of a sheet metal screw 54. Then the sheet metal screws 54 are fastened through anchor lip structure 46 and into the bottom surface 18*a* of pane receiving channel 18. A tubular shock-absorber and spacer 60 preferably encircles the shank of each screw 54. See FIGS. 5 and 6.

Each shock absorber and spacer 60 functions to absorb the impact of flying debris. The high-speed impact of a wind-propelled projectile, such as a two-by-four plank segment, swept up in hurricane winds and delivered against a pane 12 of system 10 cracks the glass in the pane 12. Film 20 in the given pane 12 remains substantially intact for the majority of such impacts and retains glass shards against entry into the building, protecting occupants from laceration injury. Film 20 also flexes and stretches, so that the deformation of film 20 absorbs some of the energy of impact. The impact also creates tension in film 20, resulting in a force on mounting members 30 directed toward the center of film 20 deformation. Mounting members 30 each bear against shock-absorber and spacer 60 during this loading, and resiliently compress each shock-absorber and spacer 60 against the head of the adjacent screw 54. See FIGS. 8 and 9. Shock-absorber and spacers 60 compression absorbs some of the impact energy, converting it into heat which is dissipated into the surrounding atmosphere through radiation.

Each shock absorber and spacer 60 also functions to extend the head of each screw 54 for convenient screw 54 access and removal after installation.

An optional and preferred additional element is a glass pane abutment member 70 having a pane bumper 72 and a bumper extending flange 74 with a bumper channel 76 for receiving a mounting stem 78 of a bumper 72. See FIGS. 2 and 4. Abutment member 70 slides longitudinally into a track 82 recessed into a first surface 84 of each base plate portion 44 of each mounting member 30. Bumper 72 is preferably a resilient tube for laterally abutting and bracing glass pane 12, and stem 78 is preferably a T-shaped cross-section branch of the tube extending laterally from the tube, which is extruded as part of the tube.

Mounting flange 34 extends upwardly from the inwardly directed edge of base plate portion 44. A first track bead 92 protrudes from the mounting flange 34 toward the other edge of base plate portion 44 and is spaced upwardly from base plate portion 44 to define one side of track 82. A second track bead 94 extends upwardly from the outward edge of base plate portion 44 and has a retaining notch 96 for engaging the abutment member 70. Abutment member 70 slides longitudinally over the upper surface of the base plate portion 44 underneath first track bead 92 and within retaining notch 96 for mounting. See FIG. 2.

Anchor lip structure 46 alternatively may laterally abut the side of a molding part 62 of an existing frame member 16. See FIG. 5. Mounting members 30 and abutment members 70 are preferably formed of extruded aluminum. System 10 is also suited to fitting and retrofitting ventilating windows and fixed glass windows. Various pane 12 thicknesses are contemplated, as well as the use of thermopane glass and parallel, double glass panes.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A glazing system for a sliding glass door including an existing glass pane and an existing door frame having an existing door frame upper surface and having a glass receiving channel recessed into said existing door frame upper surface, comprising:

a reinforced glass pane having a pane inner face for orienting toward the interior of a building and a pane outer face for orienting toward the outside of a building and having a transparent, shatter-proof film secured onto said pane inner face with film securing means, and a mounting structure having a mounting member with a member anchoring portion for securing into said channel with anchoring portion securing means and a pane mounting flange having a flange inner face for directing toward the interior of a building and a flange outer face for directing toward the outside of a building, said film being secured to said flange outer face with pane securing means.

2. A glazing system according to claim 1, wherein said mounting member comprises:

a base plate portion for resting on said existing door frame upper surface, and an anchor lip portion extending downwardly from said base plate portion for inserting into said channel.

3. A glazing system according to claim 2, wherein said anchor lip portion comprises:

a cross-sectional L-shape extension having a width adapted to make a snug fit within said channel, and a downwardly projecting bead spaced apart from the upper part of said anchor lip portion L-shape for stabilizing said mounting member.

4. A glazing system according to claim 2, further comprising mounting member securing means comprised of:

a longitudinal series of fastener head passing holes in said base plate portion of sufficient width to pass the head of a certain threaded fastener and a longitudinal series of fastener shank passing holes in said anchor lip portion of sufficient width to pass the shank of one threaded fastener and each registering with one said fastener head passing hole, and a plurality of threaded fasteners for passing through said fastener head and fastener shank holes and for passing into the bottom surface of said channel.

5. A glazing system according to claim 4, additionally comprising:

a tubular shock-absorber encircling said shanks of said threaded fasteners to absorb some of the impact of flying debris.

6. A glazing system according to claim 1, wherein said film comprises a layer of polyester laminated onto said inner pane face and a layer of polyvinyl butyral laminated onto said layer of polyester.

7. A glazing system according to claim 1, wherein said film securing means comprises an adhesive.

8. A glazing system according to claim 2, additionally comprising:

a glass pane abutment member having an elongate pane bumper member and a bumper extending and mounting structure for securing said bumper member in a position along said pane outer face for added system strength and enhanced aesthetic quality.

9. A glazing system according to claim 8, wherein said bumper extending and mounting structure comprises a bumper member receiving channel for receiving said bumper member, and wherein said abutment member slides longitudinally into a track recessed into said base plate portion.

10. A glazing system for a glass pane structure with an existing glass pane frame having an existing frame upper surface and having a existing glass pane mounting surface substantially perpendicular to said existing frame upper surface, comprising:

a reinforced glass pane having a pane inner face for orienting toward the interior of a building and a pane outer face for orienting toward the outside of a building and having a transparent, shatter-proof film secured onto said pane inner face with film securing means, and a mounting structure having a mounting member with a member anchoring portion for securing to said existing glass pane mounting surface with anchoring portion securing means and a pane mounting flange having a flange inner face for directing toward the interior of a building and a flange outer face for directing toward the outside of a building, said film being secured to said flange outer face with pane securing means.

11. A glazing system, comprising:

an existing window pane frame having an existing frame upper surface and having a glass receiving channel recessed into said existing frame upper surface, a reinforced glass pane having a pane inner face for orienting toward the interior of a building and a pane outer face for orienting toward the outside of a building and having a transparent, shatter-proof film secured onto said pane inner face with film securing means, and a mounting structure having a mounting member with a member anchoring portion for securing into said channel with anchoring portion securing means and a pane mounting flange having a flange inner face for directing toward the interior of a building and a flange outer face for directing toward the outside of a building, said film being secured to said flange outer face with pane securing means.

* * * * *